US007288925B2

(12) United States Patent
Nagata

(10) Patent No.: US 7,288,925 B2
(45) Date of Patent: Oct. 30, 2007

(54) BAND GAP REFERENCE VOLTAGE CIRCUIT

(75) Inventor: Junichi Nagata, Nukata-gun (JP)

(73) Assignee: DENSO Corporation, Kariya (JP)

( * ) Notice: Subject to any disclaimer, the term of this patent is extended or adjusted under 35 U.S.C. 154(b) by 106 days.

(21) Appl. No.: 11/242,051

(22) Filed: Oct. 4, 2005

(65) Prior Publication Data

US 2006/0071690 A1 Apr. 6, 2006

(30) Foreign Application Priority Data

Oct. 5, 2004 (JP) ..... 2004-292476

(51) Int. Cl.
*G05F 3/16* (2006.01)

(52) U.S. Cl. ..... 323/313; 323/314; 326/83

(58) Field of Classification Search ..... 326/26, 326/27, 82, 83; 323/313, 314
See application file for complete search history.

(56) References Cited

U.S. PATENT DOCUMENTS 5,229,710 A * 7/1993 Kraus et al. ..... 323/313
5,352,972 A * 10/1994 Pernici et al. ..... 323/313
5,568,045 A * 10/1996 Koazechi ..... 323/314
6,710,586 B2 3/2004 Yamamoto
6,788,131 B1 * 9/2004 Huang ..... 327/539
2006/0238215 A1 * 10/2006 Kim et al. ..... 326/1

FOREIGN PATENT DOCUMENTS

JP A-07-230332 8/1995
JP A-2002-341953 11/2002

* cited by examiner

*Primary Examiner*—Don Le
(74) *Attorney, Agent, or Firm*—Posz Law Group, PLC

(57) ABSTRACT

In a band gap reference voltage circuit, a band gap cell circuit composed of two transistors is driven with different current densities under a bias condition in which first and second reference voltages output in accordance with the operating states of the two transistors are equal to each other, thereby outputting a band gap reference voltage from a reference voltage output line. A differential amplifying circuit that is supplied with the first and second reference voltages as differential input signals subjects the differential input signals thus supplied to differential amplification. A level shift circuit is connected between a power supply line and the reference voltage output line and supplied with an output voltage of the differential amplifying circuit to carry out a level shift operation on the output voltage concerned.

3 Claims, 4 Drawing Sheets

BAND GAP REFERENCE VOLTAGE CIRCUIT

CROSS REFERENCE TO RELATED APPLICATION

This application is based upon, claims the benefit of priority of, and incorporates by reference the contents of Japanese Patent Application No. 2004-292476 filed on Oct. 5, 2004.

TECHNICAL FIELD

The technical field relates to a band gap reference voltage circuit having a band gap cell circuit for outputting a reference voltage by driving two transistors with different current densities.

BACKGROUND

FIG. 6 shows a specific circuit construction of a band gap reference voltage circuit disclosed in JP-A-2003-157119. A band gap reference voltage circuit 1 comprises a band gap cell circuit 2, a differential pair 3, a current mirror circuit portion 4, a gain forming portion 5 and an emitter follower circuit portion 6.

In the band gap cell circuit 2, a series circuit comprising a resistor R11 and an NPN transistor T11, and a series circuit comprising a resistor R12, an NPN transistor T12 and a resistor R13 are connected to each other in parallel between a reference voltage output line VBG and the ground. The bases of transistors T11 and T12 are commonly connected to the collector of the transistor T11. The resistance values of the resistors R11, R12 and R13 are adjusted so that the transistors T11 and T12 are driven with different current densities (that is, asymmetrical current is supplied to the transistors T11 and T12), whereby the band gap cell circuit 2 acts to compensate for the characteristic variation with respect to the temperature.

The differential pair 3 comprises an NPN transistor T13 having the base to which the collector (connection point A) of the transistor T11 is connected, an NPN transistor T14 having the base to which the collector (connection point B) of the transistor T12 is connected, and a resistor R14 connected between the emitter of each of the transistors T13 and T14 and the ground.

The current mirror circuit portion 4 comprises PNP transistors T15 and T16 whose bases are connected to each other. The emitters of the transistors T15 and T16 are connected to the reference voltage output line VBG through resistors R15 and R16, and the collectors of the transistors T15 and T16 are connected to the collectors of the transistors T13 and T14, respectively. The same level current is supplied to the transistors T15 and T16.

The gain forming portion 5 has a PNP transistor T17 and an NPN transistor T18. The emitter of the transistor T17 is connected to the reference voltage output line VBG through an resistor R17, the collector thereof is connected to the ground through a resistor R18 and the base thereof is connected to the collector of the transistor T14. The transistor T18 is disposed to apply a gain to amplify variation of current supplied to the transistor T14 through the transistor T17. The collector of the transistor T18 is connected to the power source VCC through a resistor R19, the base thereof is connected to the collector of the transistor T17, and the emitter thereof is connected to the ground.

The emitter follower circuit portion 6 comprises the resistor R19 and the NPN transistor T19. the collector of the transistor T19 is connected to the power source VCC, the base thereof is connected to the collector of the transistor T18, and the emitter thereof is connected to the reference voltage output line VBG. The differential pair 3, the current mirror circuit portion 4, the gain forming portion 5 and the emitter follower circuit portion 6 constitute an operational amplifier 7.

Capacitors C1 to C3 are provided for phase compensation to prevent oscillation of the operational amplifier 7. The capacitor C1 is connected between the collector and base of the transistor T14, the capacitor C2 is connected between the collectors of the transistor T14 and T17, and the capacitor C3 is connected between the collectors of the transistors T17 and T18.

Next, the operation of the band gap reference voltage circuit 1. When the collector currents of the transistors T11 and T12 are represented by Ic1 and Ic2, and the base-emitter voltages (junction voltages) of the transistors T11 and T12 are represented by VBE11 and VBE12, the current Ic2 flowing in the resistor R13 is equal to the current value corresponding to the differential voltage of the respective base-emitter voltages VBE11 and VBE12, and represented by the following equation.

$$Ic2=(VBE11-VBE12)/R13$$

Furthermore, when the base currents of the transistors T11 and T12 are represented by Ib1 and Ib2 respectively and the emitter currents of the transistors T11 and T12 are represented by Ie1 Ie2 respectively, the respective base currents Ib1 and Ib2 are sufficiently small and thus can be neglected as compared with the respective collector currents Ic1 and Ic2, and thus the respective emitter currents Ie1, Ie2 can be regarded as being equal to the collector currents Ic1 and Ic2, respectively. Accordingly, when the base-emitter voltages VBE11 and VBE12 are varied due to characteristic variation of the transistors T11 and T12, the collector current Ic2 flowing in the resistor R13 varies in connection with the variation of the base-emitter voltage VBE11, VBE12, and thus the relationship between the potentials (reference voltage) of the connection points A and B is varied. The potentials of the connection points A and B are applied as the base voltages of the two transistors T13 and T14 constituting the differential pair 3.

Here, when the collector currents of the transistors T13 and T14 are represented by I1 and I2 respectively and the current flowing in the resistor R14 connected to the collectors of the transistors T13 and T14 is represented by I, the currents I1 and I2 are basically equal to I/2 because the collector currents I3 and I4 of the transistors T15 and T16 are equal to each other. For example, when the current I2 flowing in the transistor T14 is about to increase to be larger than I/2, the collector currents I3 and 14 of the transistors T15 and T16 must keep the same value, and thus an insufficient current component is compensated by the base current of the transistor T17. Accordingly, the collector current I5 of the transistor T17, that is, the current flowing in the resistor R18 is increased, and in connection with this current increase, the collector current I6 of the transistor T18 is also increased.

The collector current I6 corresponds to the current I7 flowing in the resistor R19, and thus the base potential and the emitter potential of the transistor T19 is reduced by the increase of the collector currents I6 and I7. By the above action, the potentials at the connection points A and B are adjusted, and the output voltage VBG is fed back so that the potentials are controlled to be fixed. The emitter follower circuit portion 6 is subjected to level shift by only the amount corresponding to the base-emitter voltage to set the output voltage VBG. That is, in the band gap reference voltage circuit 1, the collector potentials of the transistors T11 and T12 in the band gap cell circuit 2 are amplified by the differential pair 3 and the current mirror circuit portion 4, and further amplified by the transistors T17 and T18 in the gain forming portion 5.

The band gap reference voltage circuit 1 thus constructed is designed so that amplification is carried out at plural stages in the operational amplifier 7. Therefore, the total gain of the circuit is increased, and also phase-delay is more liable to occur because the operation of each circuit portion is delayed, so that the circuit may fall into an oscillation operation with an extremely high probability. Therefore, the capacitors C1 to C3 are needed for phase compensation to prevent oscillation. When a semiconductor integrated circuit is constructed, capacitors occupy a very large area, and thus the circuit scale is increased. In addition, the start-up of the circuit operation when power is turned on is further delayed.

In JP-A-2003-157119, it is illustrated that only one capacitor for phase compensation is disposed. However, it is experimentally obvious that if three capacitors C1 to C3 are disposed as shown in FIG. 6, it would be actually difficult to surely suppress the oscillation operation.

SUMMARY

In view of the foregoing, it is an object to provide a band gap reference voltage circuit that can further reduce the number of connections of capacitors for phase compensation or further reduce the capacitance needed to suppress oscillation.

According to a band gap reference voltage circuit of a first aspect, first and second reference voltages in a band gap cell circuit are applied as differential input signals, and an output voltage of a differential amplifying circuit for carrying out differential amplification on these input signals is directly input to a level shift circuit without being passed through a gain forming portion unlike the conventional construction, thereby generating and outputting a band gap reference voltage.

That is, in the conventional band gap reference voltage circuit, the reason why a gain forming portion is needed resides in that there is achieved such an advantage that the offset voltage of the operational amplifying portion can be reduced to a lesser level by increasing the gain and also the operation voltage range can be set to a broader range. In an actual application of the reference voltage circuit, attention is not paid to these characteristics at all times.

Accordingly, if the circuit is designed so that the output voltage of the differential amplifying circuit is directly subjected to level shift, the gain is reduced and a phase difference allowance degree is further increased, so that the number of connections of capacitors for phase compensation can be reduced or the capacitance needed to prevent oscillation can be reduced. Accordingly, the circuit scale can be reduced, and the response speed of the circuit operation can be further increased.

According to a band gap reference voltage circuit of a second aspect, in the level shift circuit, an element to which the output voltage of the differential amplifying circuit is applied is constructed by a MOSFET. That is, when the output voltage is directly subjected to level shift without being amplified, the offset voltage is apt to increase. Therefore, with the above construction, current is hardly supplied to the gate of MOSFET serving as a voltage driving type element, and thus unbalance of current in the differential pair of the differential amplifying circuit hardly occurs. Accordingly, the offset voltage can be reduced to a less level, and the output precision of the reference voltage can be enhanced.

According to a band gap reference voltage circuit of a third aspect, a phase compensating capacitor is connected between a ground-side terminal and a signal input terminal of a transistor disposed at the amplification output side out of the transistors constituting the differential pair. With this construction, by connecting only one capacitor having relatively low capacitance, the phase difference allowance degree can be more sufficiently secured while suppressing the increase of the circuit scale as much as possible.

According to a band gap reference voltage circuit of a fourth aspect, the transistor constituting the differential amplifying circuit is constructed by adding an SOI (Silicon On Insulator) structure with a trench insulating separation structure. That is, the differential amplifying circuit portion has a risk that unbalance of current occurs due to occurrence of unconsidered current leak or formation of a parasite transistor, so that the offset voltage is increased. Therefore, with respect to at least the transistor constituting the differential amplifying circuit, occurrence of the current leak is suppressed at maximum by adopting the device structure as described above, and the operation characteristic can be stabilized with keeping the offset balance optimally.

BRIEF DESCRIPTION OF THE DRAWINGS

The above and other objects, features and advantages will become more apparent from the following detailed description made with reference to the accompanying drawings. In the drawings.

DETAILED DESCRIPTION OF THE PREFERRED EMBODIMENTS

Preferred embodiments will be described hereunder with reference to the accompanying drawings.

First Embodiment

Figure 1:
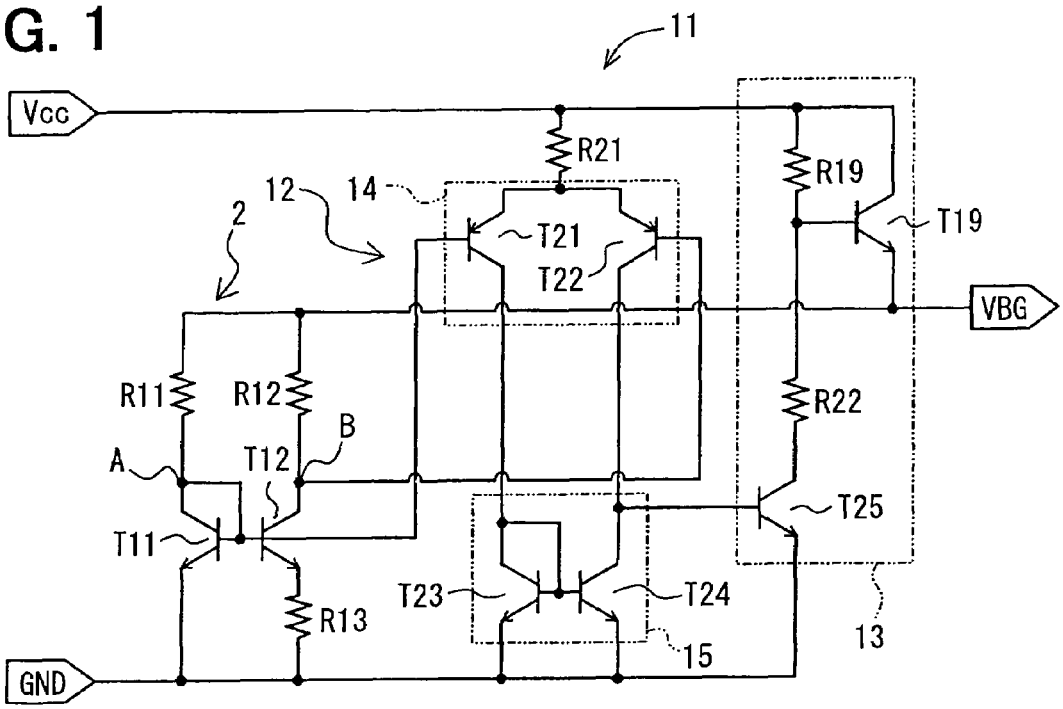
FIG. 1 is a diagram showing the construction of a band gap reference voltage circuit according to a first embodiment.
Figure 6:
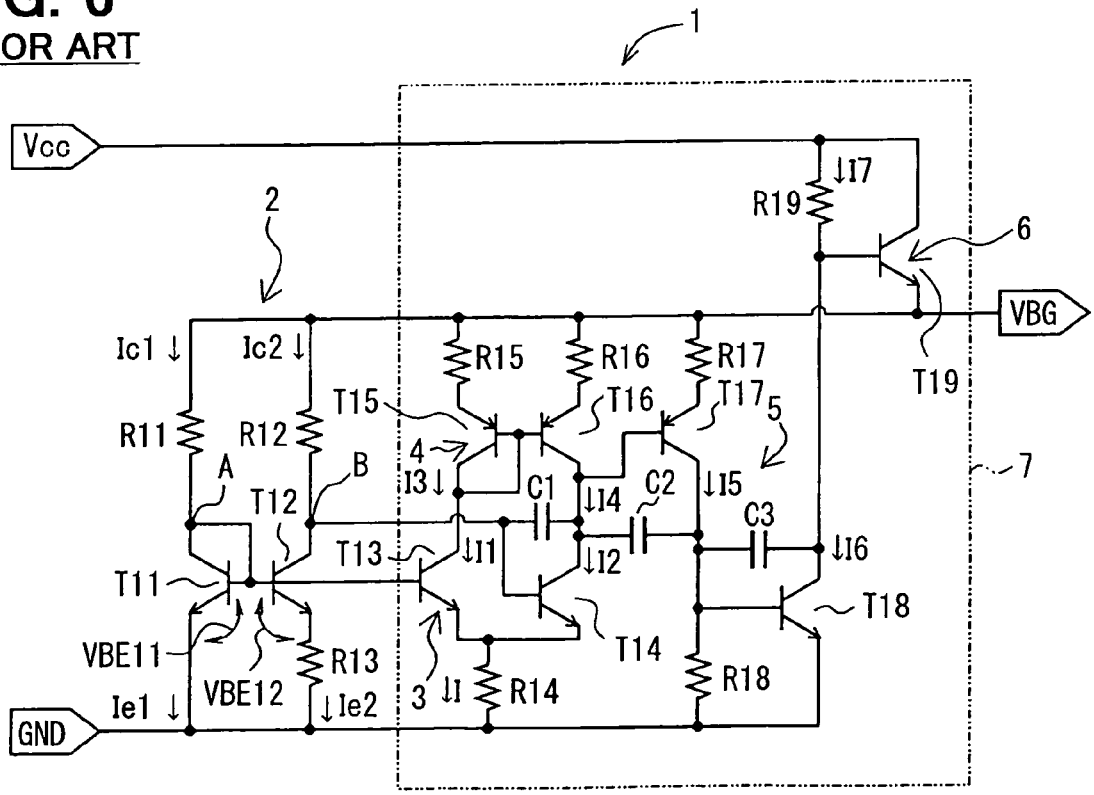
FIG. 6 PRIOR ART
FIG. 6 is a diagram showing a prior art, which corresponds to FIG. 1.

A first embodiment will be described with reference to FIG. 1. The same parts as FIG. 6 are represented by the same reference numerals, and the description thereof is omitted, and only the different portions will be described. The construction of a band gap reference voltage circuit 11 shown in FIG. 1 is achieved by replacing the portions corresponding to the differential pair 3 and the current mirror circuit portion 4 of the band gap reference voltage circuit 1 shown in FIG. 6 by a differential amplifying circuit 12, the portions corresponding to the gain forming portion 5 and the emitter follower circuit portion 6 by a level shift circuit 13 and deleting the phase compensating capacitors C1 to C3.

The differential amplifying circuit 12 is constructed by a differential pair 14 and a current mirror circuit portion 15. The differential pair 14 is constructed by two PNP transistors T21 and T22 whose emitters are commonly connected to the power source VCC through a resistor R21. The current mirror circuit portion 15 is constructed by two NPN transistors T23 and T24 which are connected to each other in a current mirror style, and the collectors of the transistors T23 and T24 are connected to the collectors of the transistors T21 and T22 respectively while the emitters thereof are connected to the ground.

The level shift circuit 13 is constructed by not only the transistor T19 and the resistor R19 constituting the emitter follower circuit portion 6, but also a PNP transistor T25 having a collector connected to the base of the transistor T19 through a resistor R22 and an emitter connected to the ground. The base of the transistor T25 is connected to the collector of the transistor T24. In the differential amplifying circuit 12, the connection relationship of the constituent parts corresponding to the resistor R21, the differential pair 14 and the current mirror circuit portion 15 is inverted to that of the construction of FIG. 6. However, this portion has no feature as a circuit, and may be replaced by the same differential amplifying circuit 3 as shown in FIG. 6.

According to the embodiment thus constructed, the output voltage of the differential amplifying circuit 12 to which the potentials (reference voltage) at the connection points A and B of the band gap cell circuit 2 are applied as a differential input signal is directly input to the level shift circuit 13 without being passed through the gain forming portion 5 unlike the conventional construction, whereby the gain of the whole circuit is reduced and the phase different allowance degree is more increased.

As a result, the oscillation operation can be suppressed even when the phase-compensating capacitors C1 to C3 needed in the prior art are deleted, and the circuit scale of the band gap reference voltage circuit 11 can be reduced. In addition to the deletion of the capacitors C1 to C3, the response speed of the circuit operation can be increased by deleting the gain forming portion 5 and reducing the number of the circuit elements.

Second Embodiment

Figure 2:
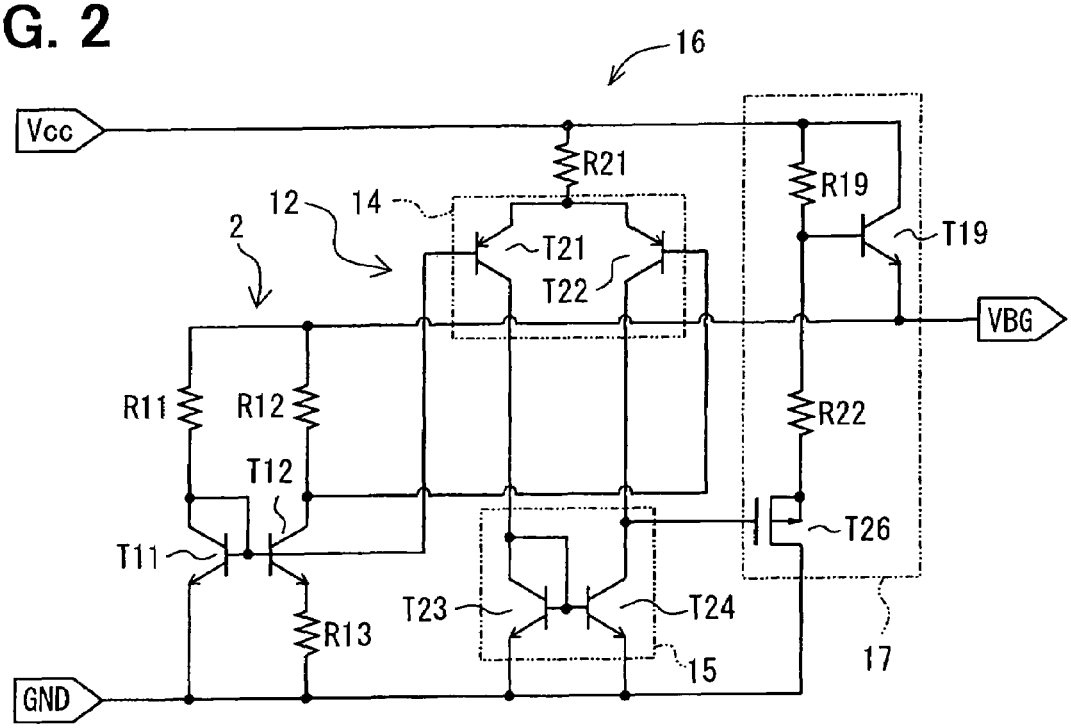
FIG. 2 is a diagram showing a second embodiment, which corresponds to FIG. 1.

FIG. 2 shows a second embodiment of the present invention. The same parts as the first embodiment are represented by the same reference numerals, and the description thereof is omitted. Only the different portions will be described. A band gap reference circuit according to a second embodiment is achieved by replacing the level shift circuit 13 of the band gap reference voltage circuit 11 of the first embodiment by a level shift circuit 17. In the level shift circuit 17, the transistor T25 is replaced by a transistor T26 comprising MOSFET.

That is, in the level shift circuit 13 of the band gap reference voltage circuit 11 of the first embodiment, the output voltage of the differential amplifying circuit 12 is received by the transistor T25, and unbalance of current occurs in the differential amplifying circuit by the degree corresponding to the current flowing into the base of the transistor T25, so that the offset voltage is apt to increase. Therefore, in the second embodiment, the output voltage of the differential amplifying circuit 12 is received by the transistor T26 which is constructed by a MOSFET and serves as a voltage driving type element. That is, current hardly flows into the gate of the transistor T26, and thus occurrence of an offset voltage in the differential amplifying circuit 12 can be suppressed, and the output precision of the reference voltage VBG can be enhanced.

Third Embodiment

Figure 3:
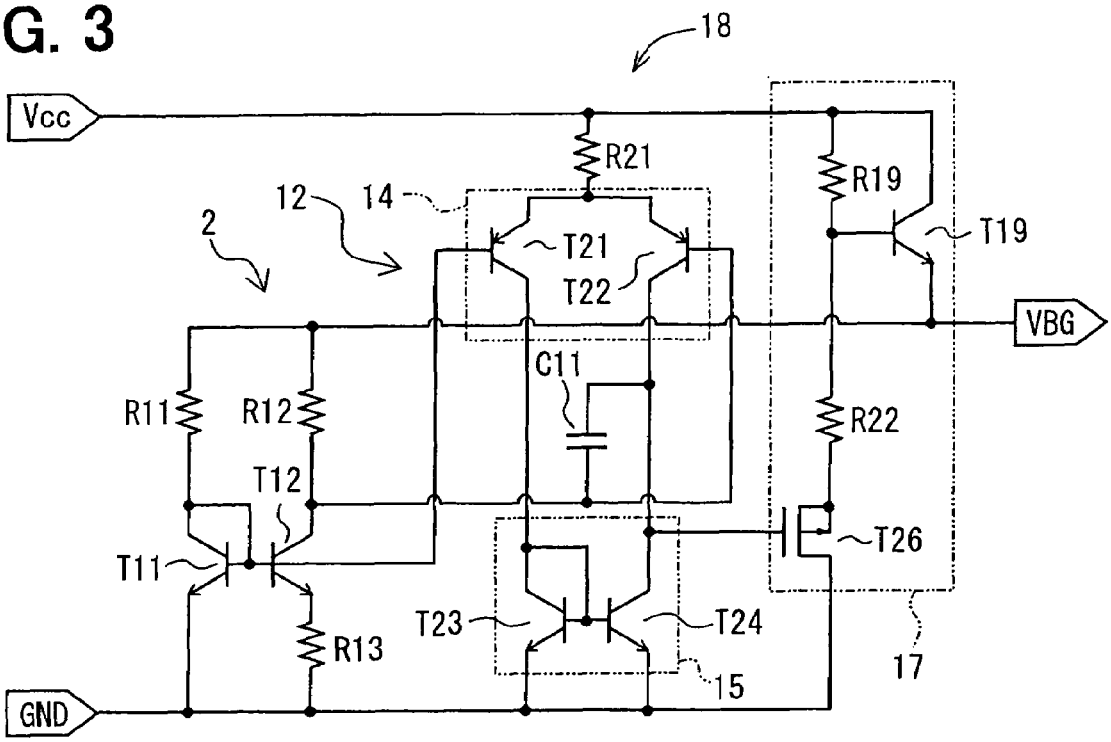
FIG. 3 is a diagram showing a third embodiment, which corresponds to FIG. 1.

FIGS. 3 and 4 show a third embodiment of the present invention, and only the different portion from the second embodiment will be described. A band gap reference voltage circuit 18 of the third embodiment is achieved by inserting a phase compensating capacitor C11 between the collector and base of the transistor T22 disposed at the amplification output side in the differential amplifying circuit 12 constituting the band gap reference voltage circuit 16 of the second embodiment. That is, by adding the capacitor C11, the band gap reference voltage circuit 18 can be provided with a larger phase difference allowance degree.

The addition of the capacitor C11 of the third embodiment is determined on the basis of a simulation result achieved by carrying out simulations as to where a capacitor should be connected in order to achieve the highest effect when it is permitted to provide only one capacitor having small capacitance.

Figure 4A:
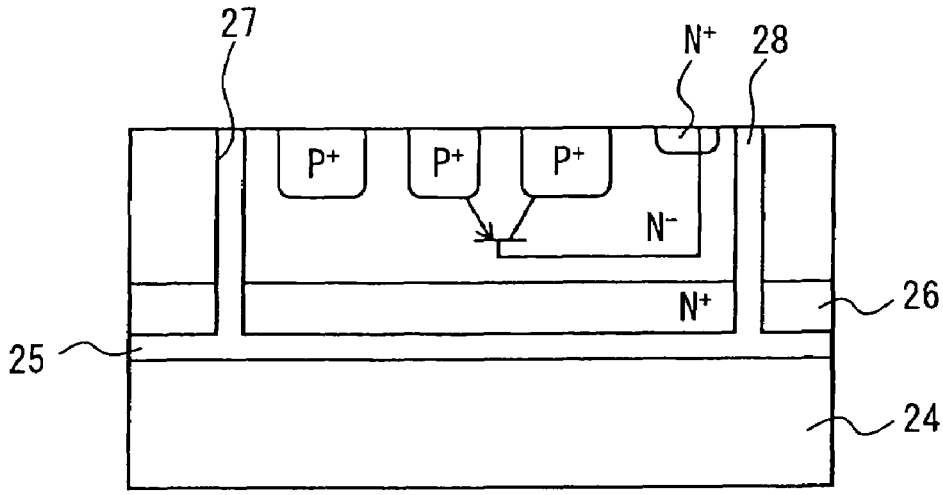
FIG. 4A is a cross-sectional view showing a semiconductor structure of an PNP transistor achieved by adding an SOI structure with a trench insulating separation structure.
Figure 4B:
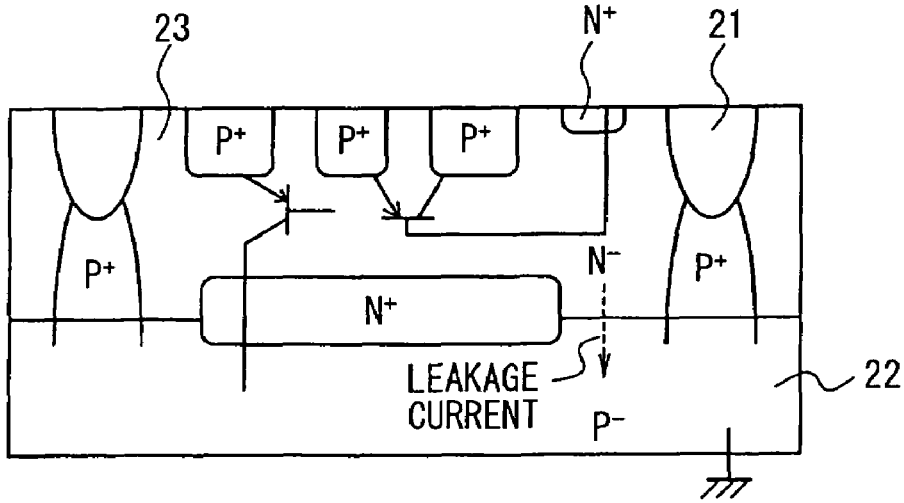
FIG. 4B is a cross-sectional view showing a junction separation structure.

In the third embodiment, each of the transistor elements constituting the band gap reference voltage circuit 18 is constructed by adding the SOI (Silicon On Insulator) structure with the trench insulating separation structure. Here, FIG. 4B is a cross-sectional view showing a case where the PNP transistor is constructed by the junction separation structure. That is, when isolation is carried out by a P-type area 21, the substrate 22 (P−) of wafer is connected to the ground which is kept to the lowest potential of the circuit, whereby the P-type area 21 disposed so as to surround the device and the N− area 23 in the device are set to be inversely biased.

On design, the operation expected to the PNP transistor controls the current between the emitter and the collector in accordance with the base current. However, in the structure shown in FIG. 4B, under a high temperature atmosphere, current leak occurs at the substrate 22 side from the N− area 23 serving as the base, and the emitter and the collector may be conducted to each other irrespective of the base current which is actually made to flow. Furthermore, a parasite transistor is formed so that P− of the substrate 22 serves as the collector of the PNP transistor, and the current of the circuit may pulled out by the parasite transistor. That is, in the band gap reference voltage circuit 18, when the transistors T21 and T22 constituting the differential pair 14 suffer such an effect as described above, the reference voltage VBG is destabilized.

Therefore, in the third embodiment, the PNP transistor is constructed by adding the SOI structure with the trench insulating separation structure. That is, $SiO_2$ oxide film 25 is formed on the substrate 24, an N+ layer 26 on the $SiO_2$ oxide film 25, and trenches are formed so as to surround the device forming area and extend to the oxide film 25 as shown in FIG. 4A. $SiO_2$ oxide film 28 is filled in the trenches 27. In this construction, no current leak occurs and no parasite transistor unlike the junction separation structure shown in FIG. 4B, and thus the operation characteristics of the band gap reference voltage circuit 18 can be stabilized under a high temperature atmosphere.

Fourth Embodiment

Figure 5:
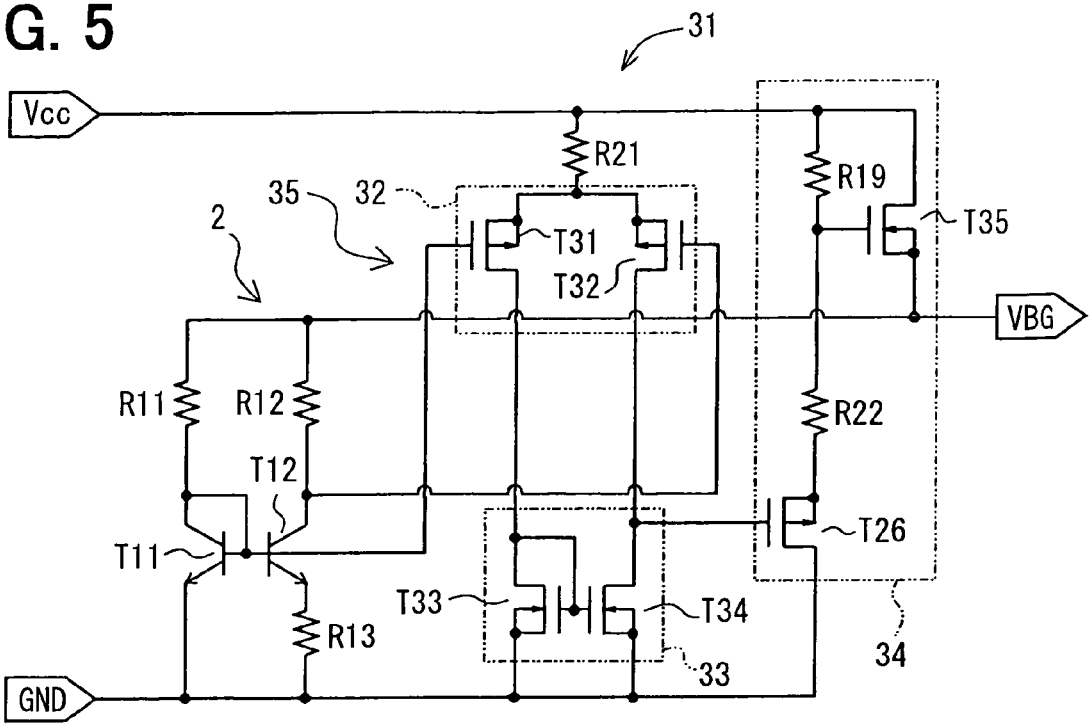
FIG. 5 is a diagram showing a fourth embodiment, which corresponds to FIG. 1.

FIG. 5 shows a fourth embodiment of the present invention, and only different portion from the second embodiment will be described. A band gap reference voltage circuit 31 of the fourth embodiment is designed so that the transistors T21 and T22 are replaced by transistors T31 and T32 comprising P-channel MOSFETs, the transistors T23 and T24 are replaced by transistors T33 and T34 comprising N-channel MOSFETs and the transistor T19 is replaced by a transistor T35 comprising an N-channel MOSFET in the band gap reference voltage circuit 16 of the second embodiment. The respective circuit portions at which the elements are replaced constitute a differential pair 32, a current mirror circuit portion 33 and a level shift circuit 34. A differential amplifying circuit 35 is constructed by the differential pair 32 and the current mirror circuit portion 33.

According to the fourth embodiment thus constructed, the dispersion of the offset voltage is apt to slightly increase as compared with the second embodiment, however, substantially the same action and effect can be achieved.

The present invention is not limited to the embodiments which are described above or illustrated in the drawings, and the following modifications may be made.

In the constructions of the first, second and fourth embodiments, the transistor achieved by adding the SOI structure with the trench insulating separation structure as in the case of the third embodiment may be used. Furthermore, the phase compensating capacitor C11 may be added like the third embodiment.

In the third embodiment, it is not necessarily applied to all the elements that the trench insulating separation structure is added to the SOI structure to form a transistor, and it may be applied at least elements constituting the differential amplifying circuit 12. This is because prevention of current leak for the differential amplifying circuit 12 is effective to suppress the offset voltage.

Alternatively, the construction of the third embodiment may be designed with a transistor formed by the junction separation structure.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A band gap reference voltage circuit comprising:

a band gap cell circuit comprising two transistors that are driven with different current densities under a bias condition in which first and second reference voltages output in accordance with the operating states of the two transistors are equal to each other, thereby outputting a band gap reference voltage from a reference voltage output line;

a differential amplifying circuit that is supplied with the first and second reference voltages as differential input signals and subject the differential input signals thus supplied to differential amplification; and a level shift circuit that is connected between a power supply line and the reference voltage output line and supplied with an output voltage of the differential amplifying circuit to carry out a level shift operation on the output voltage concerned, wherein in the level shift circuit, an element to which the output voltage of the differential amplifying circuit is applied is constructed by MOSFET.

2. A band gap reference voltage circuit comprising:

a band gap cell circuit comprising two transistors that are driven with different current densities under a bias condition in which first and second reference voltages output in accordance with the operating states of the two transistors are equal to each other, thereby outputting a band gap reference voltage from a reference voltage output line;

a differential amplifying circuit that is supplied with the first and second reference voltages as differential input signals and subject the differential input signals thus supplied to differential amplification; and a level shift circuit that is connected between a power supply line and the reference voltage output line and supplied with an output voltage of the differential amplifying circuit to carry out a level shift operation on the output voltage concerned, wherein a phase compensating capacitor is connected between a ground-side terminal and a signal input terminal of a transistor disposed at an amplification output side out of transistors constituting the differential pair of the differential amplifying circuit.

3. A band gap reference voltage circuit comprising:

a band gap cell circuit comprising two transistors that are driven with different current densities under a bias condition in which first and second reference voltages output in accordance with the operating states of the two transistors are equal to each other, thereby outputting a band gap reference voltage from a reference voltage output line;

a differential amplifying circuit that is supplied with the first and second reference voltages as differential input signals and subject the differential input signals thus supplied to differential amplification; and a level shift circuit that is connected between a power supply line and the reference voltage output line and supplied with an output voltage of the differential amplifying circuit to carry out a level shift operation on the output voltage concerned, wherein a transistor constituting the differential amplifying circuit is constructed by adding an SOI (Silicon On Insulator) structure with a trench insulating separation structure.

* * * * *